US008069764B2

(12) United States Patent
Mirabello

(10) Patent No.: US 8,069,764 B2
(45) Date of Patent: Dec. 6, 2011

(54) SHEARING APPARATUS WITH CLAMPS FOR CARRYING AND LOCKING THE MATERIAL

(75) Inventor: Ernesto Mirabello, Gambolo (IT)

(73) Assignee: ATOM S.p.A., Vigevano (PV) (IT)

( * ) Notice: Subject to any disclaimer, the term of this patent is extended or adjusted under 35 U.S.C. 154(b) by 574 days.

(21) Appl. No.: 12/215,852

(22) Filed: Jun. 30, 2008

(65) Prior Publication Data

US 2009/0038457 A1 Feb. 12, 2009

(30) Foreign Application Priority Data

Aug. 9, 2007 (IT) ..... MI20070287 U

(51) Int. Cl.
*B26D 7/06* (2006.01)

(52) U.S. Cl. ..... 83/452; 83/261; 83/262

(58) Field of Classification Search ..... 83/650, 83/282, 452, 460–461, 261, 262; 227/29, 227/39, 76

See application file for complete search history.

(56) References Cited

U.S. PATENT DOCUMENTS

| | | | | | |
|---|---|---|---|---|---|
| 3,300,113 | A | * | 1/1967 | Lane | 226/110 |
| 3,701,299 | A | * | 10/1972 | Stumpf | 83/72 |
| 3,795,166 | A | * | 3/1974 | Brand | 83/409 |
| 3,823,629 | A | * | 7/1974 | Bleimund | 83/94 |
| 3,991,926 | A | * | 11/1976 | Marks | 227/21 |
| 4,151,770 | A | * | 5/1979 | D'Angelo et al. | 83/262 |
| 4,699,031 | A | * | 10/1987 | D'Angelo et al. | 83/23 |

* cited by examiner

*Primary Examiner* — Boyer D Ashley

*Assistant Examiner* — Omar Flores Sanchez

(74) *Attorney, Agent, or Firm* — Bucknam and Archer

(57) ABSTRACT

A shearing apparatus (10) for material unwound from reels comprises a support frame (12) for a working table (14) whereon a moving tape (16) is wound; said apparatus is provided with means for the temporary stabilization along at least a crosswise extended zone of said material arranged on the moving tape (16).

7 Claims, 4 Drawing Sheets

SHEARING APPARATUS WITH CLAMPS FOR CARRYING AND LOCKING THE MATERIAL

CROSS REFERENCE TO RELATED APPLICATIONS

Applicant claims priority under 35 U.S.C. §119 of Italian Application No. MI2007U000287 filed Aug. 9, 2007, the disclosure of which is hereby incorporated by reference.

This invention relates to a shearing apparatus provided with clamps for carrying and locking the material.

More in particular, this invention relates to an apparatus as defined above wherein the material to be sheared, either leather, hide or and preferably synthetic material, cardboard and the like, unwinds from a reel and is locked on the working table by means of a crosswise extended clamp and is made to advance, along the same working table, by one or more similar clamps.

As is known, especially in the production of leather and hide products and shoes, specific machines are used wherewith the material is cut according to predetermined shapes and sizes.

Machines typically used to this end are the so-called die-cutters, constructed according to different types such as with travelling arm, carriage and bridge.

Such die-cutters require the use of variedly shaped frames and with cutting edge, called dinking dies, for shearing the material placed on the working or cutting table.

Another type of machine used to this end comprises an extended cutting table whereon the material is arranged, which is sheared by blades carried by one or more supports or heads with electronic drive, that is, managed by software that pilots each cutting head which follows the programmed path, sometimes highlighted by the projection of the shapes to be obtained on the material. Shearing machines or apparatus of this type are appreciated since the table whereon the material is arranged is much extended and can receive as much extended parts of the material itself that is unwound, for example, from a reel.

Not only for cutting leather and hide typical in the footwear and leather field, but also synthetic materials of various types, fabrics, foamed and fiber cardboards are generally subject to shearing on this apparatus; it further has the important advantage of not requiring the use of dinking dies, with saving in terms of production costs and time. The cut, moreover, is very precise and the products thus obtained do not require secondary machining operations such as milling and the like.

This apparatus with cutting tables, however, show a disadvantage related to the movement of the material to be sheared on the cutting table.

As regards the movement, the material that is arranged on the cutting table is progressively unwound by a manual operation from the relative reel(s) but such unwinding is often inaccurate or at least imprecise as regards the amount; in other words, it is not possible to unwind the material from the reel by a precise and predetermined amount, with the consequence that said material is not fully used.

The stabilization of the material on the working table, on the other hand, is generally carried out by suction systems, which are actuated by the entire surface of the table itself or only by the parts each time subject to shearing. These are solutions that are sometimes not sufficient as they do not ensure precise and constant steady positioning of the material itself.

In any case, the cut is imperatively carried out on a single sheet or layer of material, since overlapping two layers for shearing multiple pieces at the same time would not ensure stability of the most superficial layer. The object of this invention is to obviate the disadvantages mentioned hereinabove.

More in particular, the object of this invention is to provide an apparatus with cutting table wherein the material whereon the shearing is carried out is locked in a quick and effective manner by easy to actuate means. A further object of the invention is to provide an apparatus with cutting table wherein the material is unwound from the reel in a very precise manner as regards amount and development.

A further object of the invention is to provide an apparatus as defined above wherein said material is also automatically movable on the cutting table.

Last but not least, another object of the invention is to provide an apparatus which allows arranging two or more layers of materials, either homogeneous or heterogeneous, on the cutting table, for simultaneously shearing a double or multiple numbers of products.

A further object of the finding is to provide the users with an apparatus with cutting table suitable for ensuring high level of resistance and reliability over time, also such as to be easily and inexpensively constructed.

These and yet other objects are achieved by the shearing apparatus according to claim 1. Further features of the invention are stated in the dependent claims.

The construction and functional features of the shearing apparatus with clamps for carrying and locking the material of this invention shall be better understood from the following detailed description, wherein reference is made to the annexed drawing tables showing a preferred and non-limiting embodiment thereof and wherein.

Figure 1:
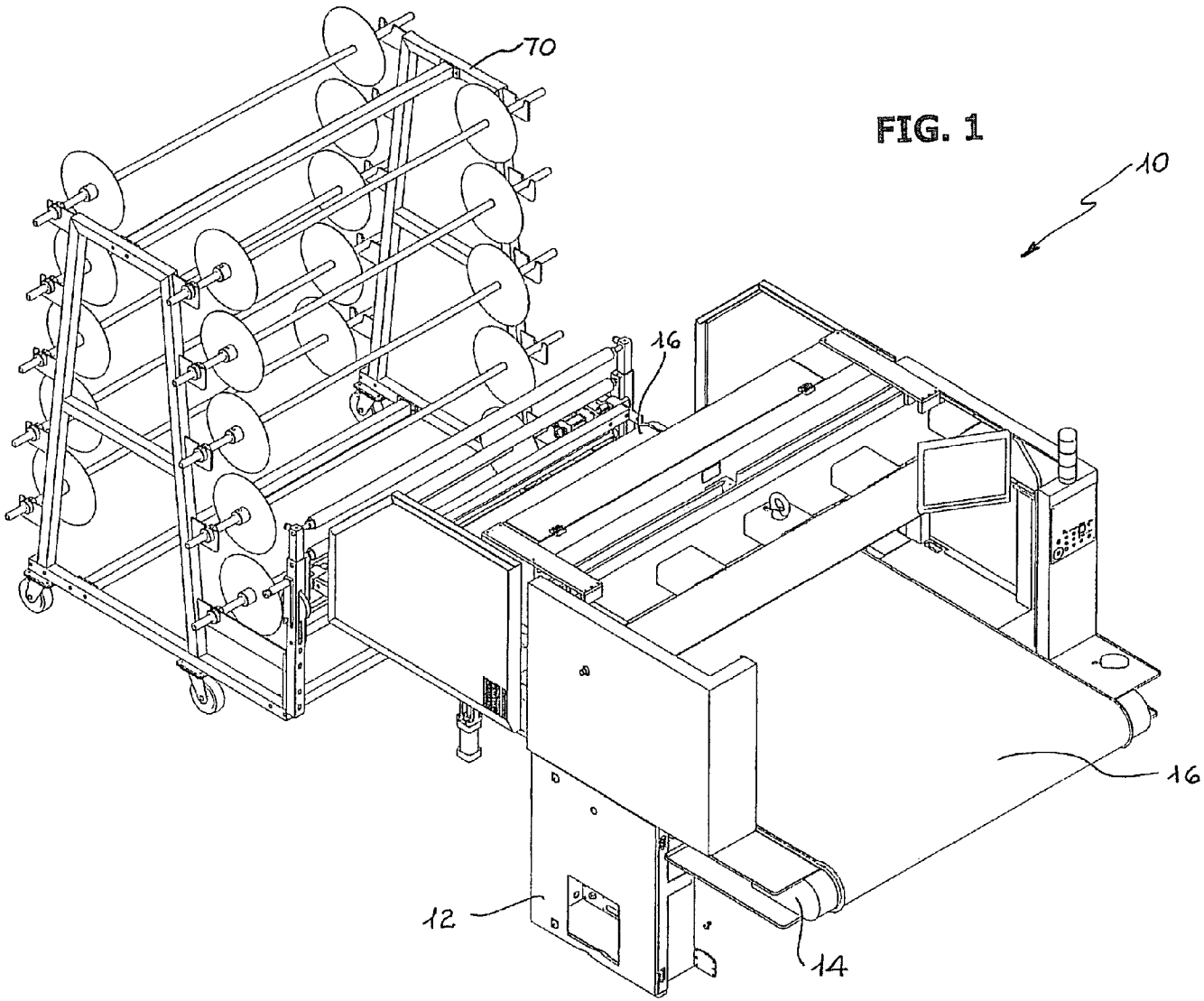
FIG. 1 shows a schematic perspective top view of the shearing apparatus of this invention associated by way of an example to a carriage carrying a plurality of supports for reels of material to be sheared.
Figure 3:
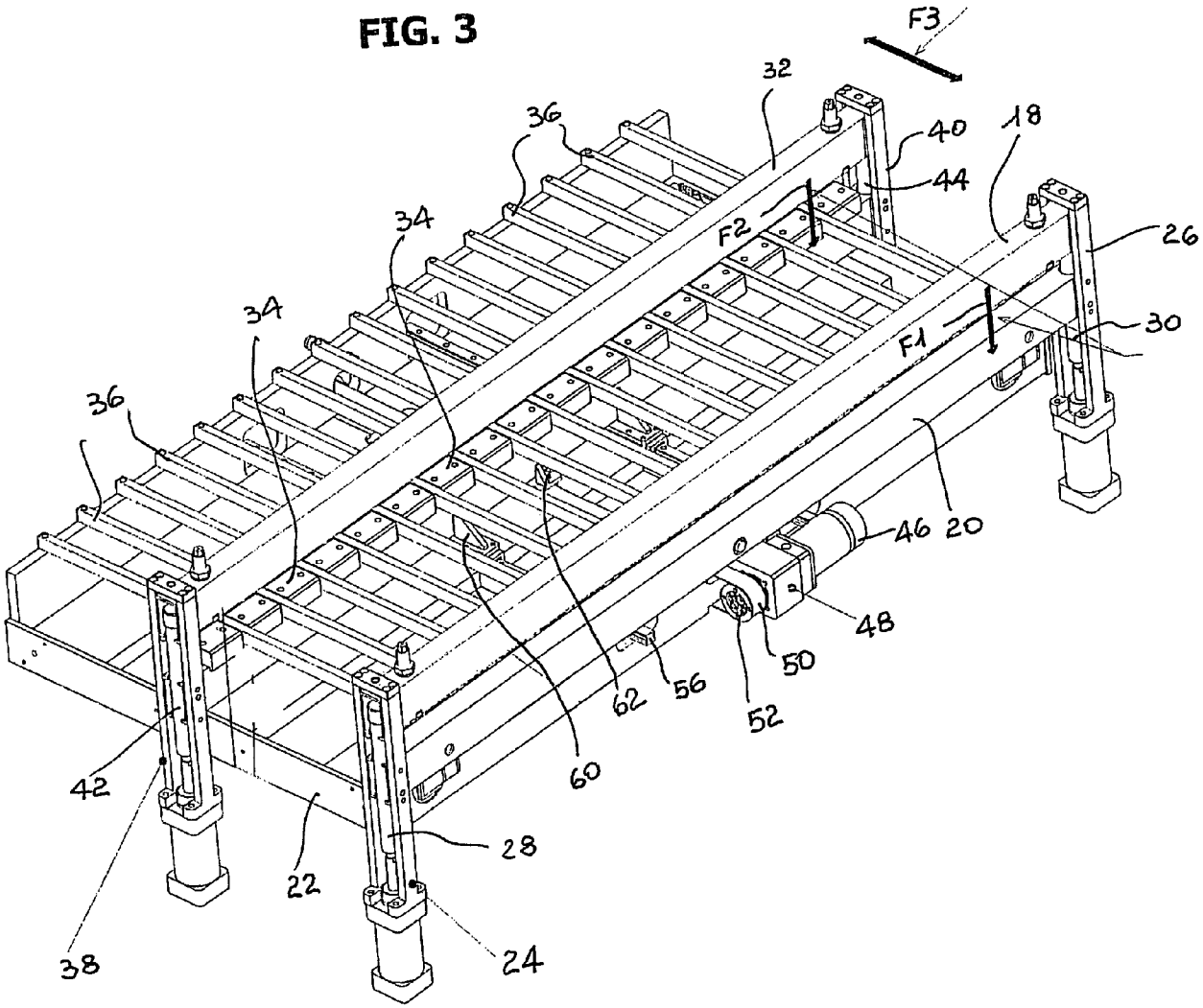
FIG. 3 shows a schematic perspective top view of a part of the same apparatus.
Figure 4:
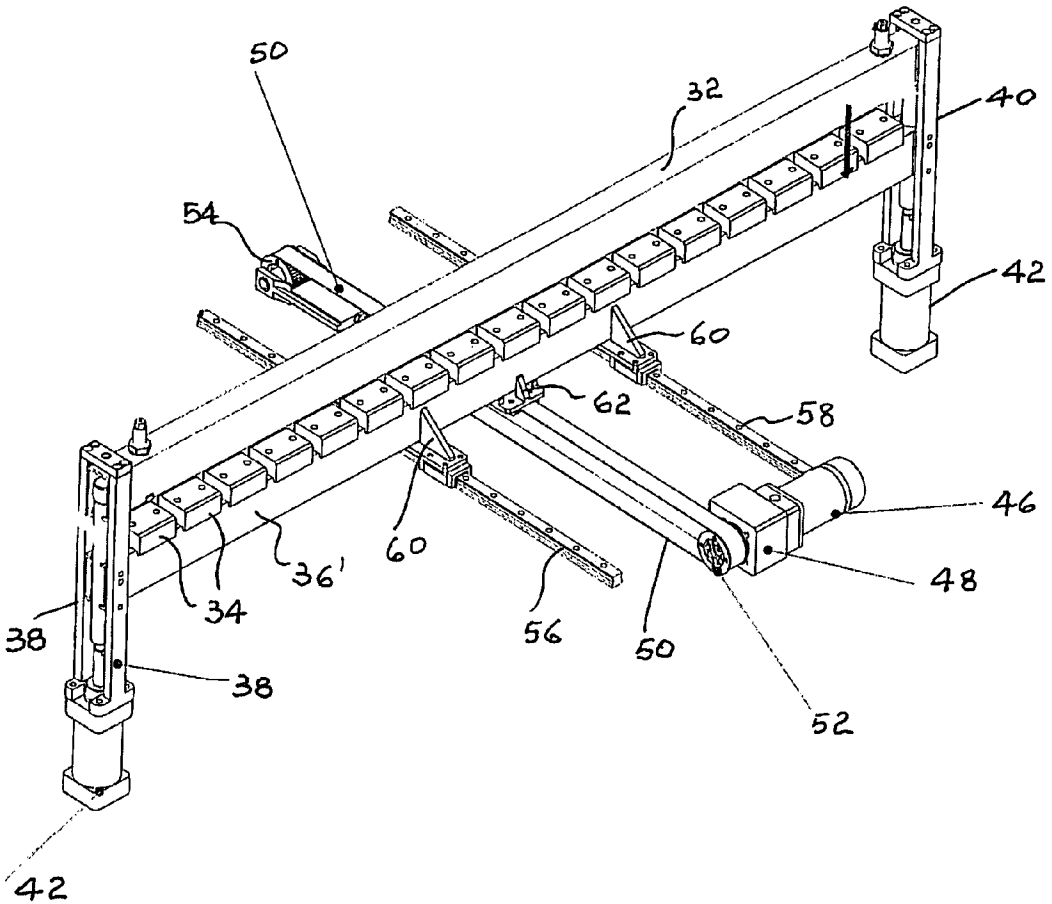
FIG. 4 shows a schematic perspective top view of the part of the apparatus regarding the means intended for moving the material on the cutting table.

With reference to the above figures, the shearing apparatus with clamps for carrying and locking the material of this invention, globally indicated with 10 at FIG. 1, comprises a support frame 12 for a working table 14 whereon a moving tape 16 of synthetic material is wound, returned to the opposite ends on conventional rolls or the like (not shown). According to the invention, tape 16 is associated to moving means for the temporary stabilization of the material to be sheared and for the advance thereof according to predetermined extents. The moving means for the temporary locking or stabilization of the material on tape 16 consist of a first clamp formed by two overlapped top 18 and bottom 20 bars, extending crosswise by the entire width of the tape itself in the central-front part of the apparatus. The first clamp composed of said top 18 and bottom 20 bars is secured, along with the actuating devices thereof, to the support tank 22 which defines said working table 14. The bottom bar 20 is fixed and is arranged below the exposed front of tape 16 and acts as abutment for the top bar 18 which, on the contrary, is mobile, as it can move in vertical direction as indicated by arrow "F1" of FIG. 3.

The opposite ends of bars 18 and 20 are connected to respective vertical supports 24 and 26 that incorporate a piston 28, 30 each, with hydraulic or pneumatic actuation. Said pistons, in particular, provide to the vertical movement of the top bar 18, which overhangs tape 16 and in the lowering and lifting, it is guided by conventional devices of the runner type and the like, received in the vertical supports 24 and 26. The lowering of the top bar 18 abuts on the material arranged on the tape 16 and locks it in cooperation with the bottom bar 20, thus allowing the shearing head or heads (not shown) to operate with precision and speed.

Figure 2:
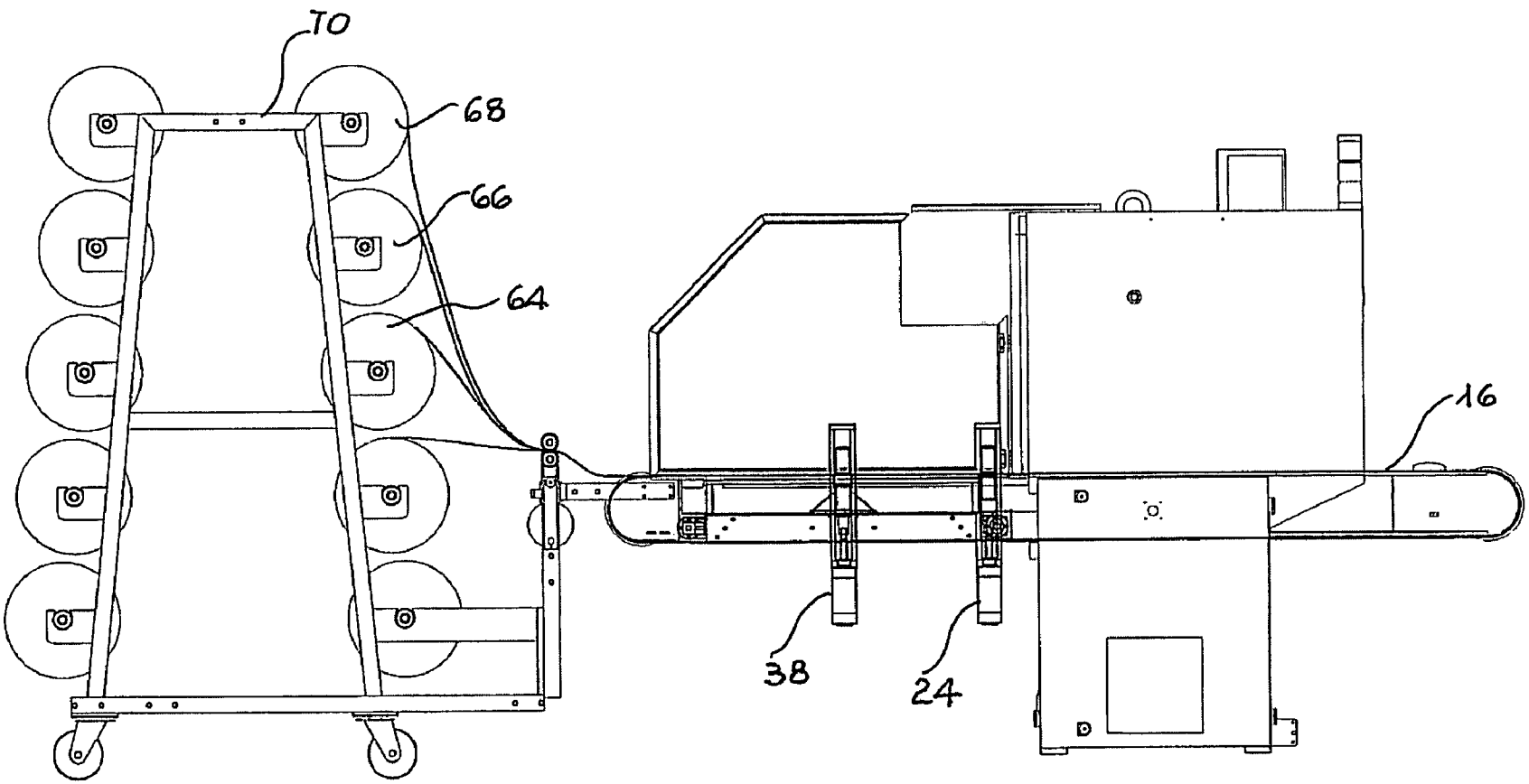
FIG. 2 shows a schematic side view of the same apparatus, for highlighting the concurrent pick up of material to be sheared from multiple reels.

The apparatus of this invention further comprises moving means intended for advancing the material, especially suitable for materials that unwind from reels, as schematized at FIG. 2. Said advance means consist of a second clamp, arranged upstream of the first one and formed of a top bar 32, extending crosswise above tape 16 and parallel to bar 18; the top bar 32 cooperates with underlying stops fixed to a bar 36' and preferably composed of a plurality of blocks 34 aligned to one another in crosswise direction and alternating with laths 36 aligned in longitudinal direction, also forming the support frame for tape 16. Laths 36 are fixed to the support tank 22. At the opposite ends, bars 32 and 36' are connected to respective supports 38, 40, similar to supports 28, 30 and likewise provided with a cylinder 42, 44 suitable for the vertical movement of the bar 32 according to the direction of arrow "F2" of FIG. 3.

Besides the second clamp, the means for advancing the material comprise a motor unit 46 with reduction unit 48 for the movement in alternating direction, along a plane parallel to the tape 16, of at least one belt 50 returned on opposite pulleys 52, 54; the belt 50 develops orthogonally relative to the bars 32 and 36', that is, in the direction of sliding of the tape 16.

A linear guide 56, 58 is arranged at the opposite sides of the belt 50 wherefrom shaped projections 60 protrude, constrained on at least one front to bar 36'; a similar projection 62 is fixed to the belt 50. The belt 50 and the guides 56, 58 are arranged in the tank 22, which on the front forms the support for the motor 46 and relative reduction unit 48. Said shaped projections 60 are constrained at the bottom to respective linear bearings that slide along the guides 56, 58 and that under the action of the motor 46 suitable for moving the belt 50, pull the bar 36' forward or push it backward. The supports 38 and 40 engage the bar 36' that slides in the tank 22 on the above guides 56, 58. The second clamp consisting of the bar 32 cooperating with the blocks 34 can thus move also along a horizontal plane, in the direction of arrow "F3" of FIG. 3, to advance the tape 16 and the material arranged thereon.

In this way it is advantageously possible to overlap multiple layers of material and feed them at the same time, for example start from the unwinding thereof from respective reels 64, 66, 68, carried by a carriage 70 on the tape 16.

Also the advance of the material composed of overlapped layers is obtained with the necessary accuracy, without the possibility of relative movements between the two or more overlapped layers, thanks to the operation of the second clamp and of the belt 50 that move the tape 16 and said material arranged thereon at the same time.

As can be noticed from the above, the advantages achieved by the invention are clear.

In the shearing apparatus of this invention, the first locking clamp of the material carries out the effective action of safely stabilizing the material itself during the cutting steps, while the second clamp properly carries out the movement thereof. Said material, moreover, remains suitably tensioned by the first clamp, even if it consists of two or more overlapped layers.

The invention claimed is:

1. A shearing apparatus (10) for a sheet material unwound from reels, said apparatus comprising:

a working table (14) on which an endless moving tape (16) is wound and over which said sheet material is cut by at least one shearing head, said working table being supported by a support frame (12);

a first clamp for the temporary stabilization of said sheet material comprising a top bar (18) overlapping a bottom bar (20); and a second clamp upstream from said first clamp for advancing said sheet material and comprising a top bar (32) extending above the tape(16) and cooperating with a plurality of undulying blocks (34) aligned in a crosswise direction which alternate with a plurality of laths (36) aligned in a longitudinal direction, said blocks (34) and laths (36) being arranged in a support tank (22) and forming a support frame for said moving tape (16), said first and second clamps being disposed along a least a crosswise extended zone of said sheet material arranged on the moving tape (16).

2. The apparatus according to claim 1, wherein the top bar (18) and bottom bar (20) of said first clamp are connected at opposite ends to respective vertical supports (24, 26) each provided with a hydraulic or pneumatic piston (28, 30) suitable for moving the top bar (18) that overhangs the tape (16) in vertical direction, the bottom bar (20) being arranged below the exposed front of the tape itself.

3. The apparatus according to claim 1, wherein the blocks (34) are fixed to an underlying bar(36') and the laths (36) are fixed to the support tank (22), said second clamp top bar (32) and underlying bar (36') being connected at their respective ends to a support (38, 40) comprising a hydraulic or pneumatic cylinder (42, 44) suitable for moving the second clamp top bar (32) in a vertical direction.

4. The apparatus according to claim 3, wherein the supports (38, 40) of the second clamp top bar (32) and underlying bar (36') are fixed to the underlying bar (36') that slides into the support tank (22).

5. The apparatus according to claim 4 wherein said second clamp comprising said top bar (32) and said underlying bar (36') cooperates with at least one belt (50), returned on opposite pulleys (52,54) arranged below said underlying bar (36') which is engaged by one or more projections (62) arranged on said belt (50), the belt (50) being oriented orthogonally relative to the underlying bar (36') and moved intermittently in opposite directions by a motor (46) with motor reduction unit (48) along a plane parallel to the tape (16).

6. The apparatus according to claim 5, wherein opposite guides (56, 58) are provided laterally relative to the belt (50) which extend in the support tank (22) parallel to the belt and wherefrom one or more shaped projections (60) protrude, engaged with at least one front of the underlying bar (36') and fixed with the bottom front to linear bearings sliding along said guides.

7. The apparatus according to claim 6, wherein the material to be sheared unwinds from one of more reels carried by a carriage (70) and is arranged in a single layer or overlapped layers on the tape (16) where it is subject to the action of the first and second clamps.

* * * * *